US005209280A

United States Patent [19]

Gevas

[11] Patent Number: 5,209,280

[45] Date of Patent: May 11, 1993

[54] PROTECTIVE HOOD FOR GOLF CLUBS

[76] Inventor: Peter D. Gevas, 63 Fox La., Dix Hills, N.Y. 11746

[21] Appl. No.: 791,788

[22] Filed: Nov. 12, 1991

[51] Int. Cl.[5] ..... A63B 57/00

[52] U.S. Cl. ..... 150/159; 206/315.4

[58] Field of Search ..... 206/315.2-315.7; 150/159, 160; 211/70.2; 215/275; 220/320

[56] References Cited

U.S. PATENT DOCUMENTS

| | | | |
|---|---|---|---|
| D. 256,293 | 8/1980 | Edwards | 206/315.4 X |
| 936,698 | 10/1909 | Breakspear | 206/315.6 |
| 948,347 | 2/1919 | Schleicher | 215/275 |
| 1,119,508 | 12/1914 | Headley | 206/315.4 |
| 1,149,028 | 8/1915 | Chapman | 206/315.4 X |
| 1,414,875 | 5/1922 | Hanaford | 206/315.4 |
| 1,562,030 | 11/1925 | Lawrence | 206/315.4 |
| 1,570,510 | 1/1926 | McQuirk | 206/315.4 |
| 1,644,592 | 10/1927 | Howland | 206/315.4 |
| 1,731,588 | 10/1929 | Patterson | 206/315.6 |
| 1,770,060 | 7/1930 | Barlow | 206/315.6 |
| 1,899,825 | 2/1933 | Reach | 206/315.4 |
| 1,918,447 | 7/1933 | Blatz | 206/315.6 X |
| 2,267,226 | 12/1941 | White | 211/70.2 |
| 2,340,896 | 2/1944 | Neef, Jr. | 220/320 |
| 2,412,603 | 12/1946 | Dauphinais | 220/320 |
| 2,509,195 | 5/1950 | Barron | 206/315.4 |
| 2,844,275 | 7/1958 | Keller | 220/320 |
| 3,460,597 | 8/1969 | Daly | 206/315.4 |
| 3,977,451 | 8/1976 | Duba | 206/315.4 |
| 3,985,171 | 10/1976 | Summers et al. | 206/315.4 |
| 4,078,594 | 3/1978 | Oeckl | 206/315.4 |
| 4,249,586 | 2/1981 | Setani | 206/315.4 |
| 4,383,563 | 5/1983 | Kirchhoff, Jr. | 206/315.3 X |
| 4,442,937 | 4/1984 | Delauder | 206/315.4 |
| 4,538,728 | 9/1985 | Lewis | 206/315.3 |
| 4,860,889 | 8/1989 | Lemieux et al. | 206/315.6 |
| 5,005,623 | 4/1991 | Webster, Jr. | 150/159 |

FOREIGN PATENT DOCUMENTS

| | | | |
|---|---|---|---|
| 216273 | 10/1955 | Australia | 206/315.3 |
| 101041 | 8/1916 | United Kingdom | 206/315.3 |
| 332636 | 7/1930 | United Kingdom | 206/315.5 |
| 376766 | 7/1932 | United Kingdom | 206/315.3 |
| 756946 | 9/1956 | United Kingdom | 206/315.5 |

*Primary Examiner*—Sue A. Weaver

*Attorney, Agent, or Firm*—Howson and Howson

[57] ABSTRACT

A two-piece golf bag hood attachable to the top of a conventional or customized golf bag for providing hard-shell protection to clubs contained therein. One piece is fabricated of a generally elongate rectangular flat sheet of hard flexible material which is manually curved under stress lengthwise to form a sleeve around the collar opening of the bag with overlapping ends joined by fasteners to form a rigid sleeve extending beyond the club ends. The other piece is a flat panel of similar material which forms a lid fastenable over the end of the sleeve. Various other fasteners secure the sleeve and lid to appendages on the bag.

9 Claims, 3 Drawing Sheets

FIG.3
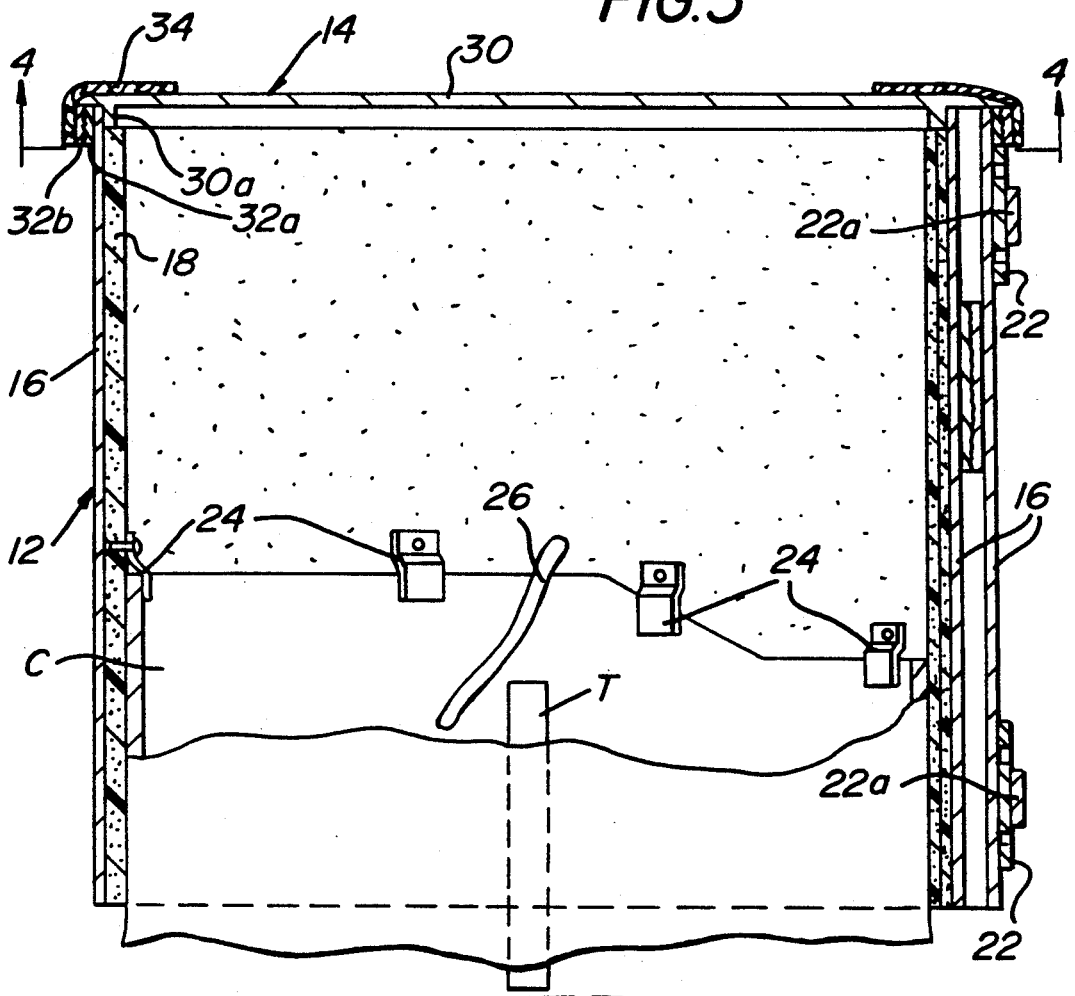
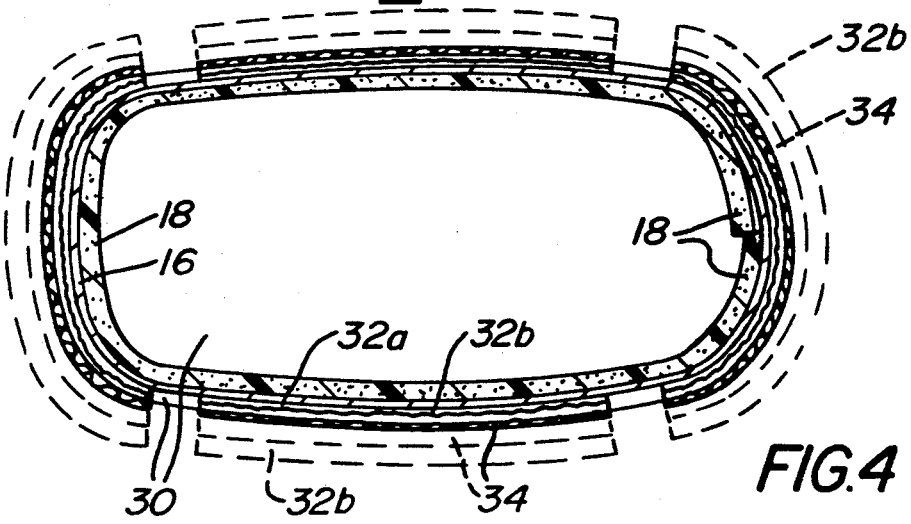
FIG.4

PROTECTIVE HOOD FOR GOLF CLUBS

BACKGROUND OF THE INVENTION

The present invention relates generally to golf bag hoods; and, more particularly, to a novel and improved hood assembly suitable for compact storage and attachment to golf bags for protecting golf clubs from damage in transit.

Traveling with a golf bag and clubs poses risks of them being damaged during transport, especially from baggage handling on airlines. Unquestionably, the best commercially marketed protectors are rigid, lightweight carrying cases which surround the entire bag and clubs. However, they are expensive and their size makes them almost impossible to fit into the trunk compartment of most automobiles, even into the largest of trunk compartments if there is also a suitcase to stow.

Less expensive golf club protectors use a one-piece hood attachable to the top of the golf bag to enclose only the protruding clubs. U.S. Pat. Nos. 1,414,875 to Hanaford and 1,570,510 to McQuirk each discloses a one-piece cover defined by a flat top with a downwardly projecting sleeve for encircling the top opening of the golf bag. Their configuration and substantially rigid construction prevent them from being rolled up for storage in the bag itself, or from being flattened out for placement between bulky items. U.S. Pat. No. 3,985,171 to Summers et al. discloses a golf bag cover designed to separate the irons from the woods during transport. Although the cover is more pliable and amenable to storing in a golf bag, it provides no hard-shell protection of the clubs against external impact.

SUMMARY OF THE INVENTION

Accordingly, it is an object of the present invention to provide a novel and improved a golf bag hood which can be readily attachable over the top of the bag for reliably protecting protruding clubs from damage due to rough handling such as might occur in transit.

Another object is to provide a golf bag hood which provides hard-shell protection to clubs within the bag against external impact, which can be readily tailored to fit on most conventional or customized golf bags, and which can be quickly installed on a golf bag.

Still another object is to provide a relatively inexpensive two-piece golf bag hood which can be easily assembled and disassembled for convenient storage flat or along curved walls of the trunk compartment of an automobile, or rolled up for storage in the golf bag.

A further object is to provide a protective hood for golf bags which is suitable for universal application on a variety of golf bags of different size and shape openings.

Briefly, these and other objects of the invention are achieved by a two-piece hood attachable over the top of a conventional or customized golf bag containing protruding clubs. One piece includes a generally rectangular flat sheet of hard flexible material which may be curved lengthwise under stress completely around the collar opening of the bag with the ends joined by fasteners to form a sleeve extending beyond the ends of the clubs. The other piece includes a flat panel of the same material with a perimeter generally congruent with the shape of the collar opening to form a lid attachable by fasteners to enclose the extended end of the sleeve. Clips and ties affixed to the inner and outer surfaces of the sleeve enable the hood to be secured to various golf bag appendages such as the handle, back strap, umbrella loop, compartment lanyards, etc. The inner surfaces of the sleeve and lid may be lined with an elastic material to cushion the impact of loose clubs against the hood. In its assembled form, the sleeve is axially and radially rigid thus affording substantial protection to the clubs against abuse and rough handling in transit.

For a better understand of these and other objects and aspects of the invention, reference will be made to the following detailed description when considered in conjunction with the accompanying drawings.

BRIEF DESCRIPTION OF THE DRAWINGS

FIG. 3 is a sectional view of the assembled hood taken along the line 3—3 of FIG. 2;

FIG. 4 is a sectional view of the assembled hood with a lid taken along the line 4—4 of FIG. 3;

DESCRIPTION OF THE PREFERRED EMBODIMENTS

Figure 1:
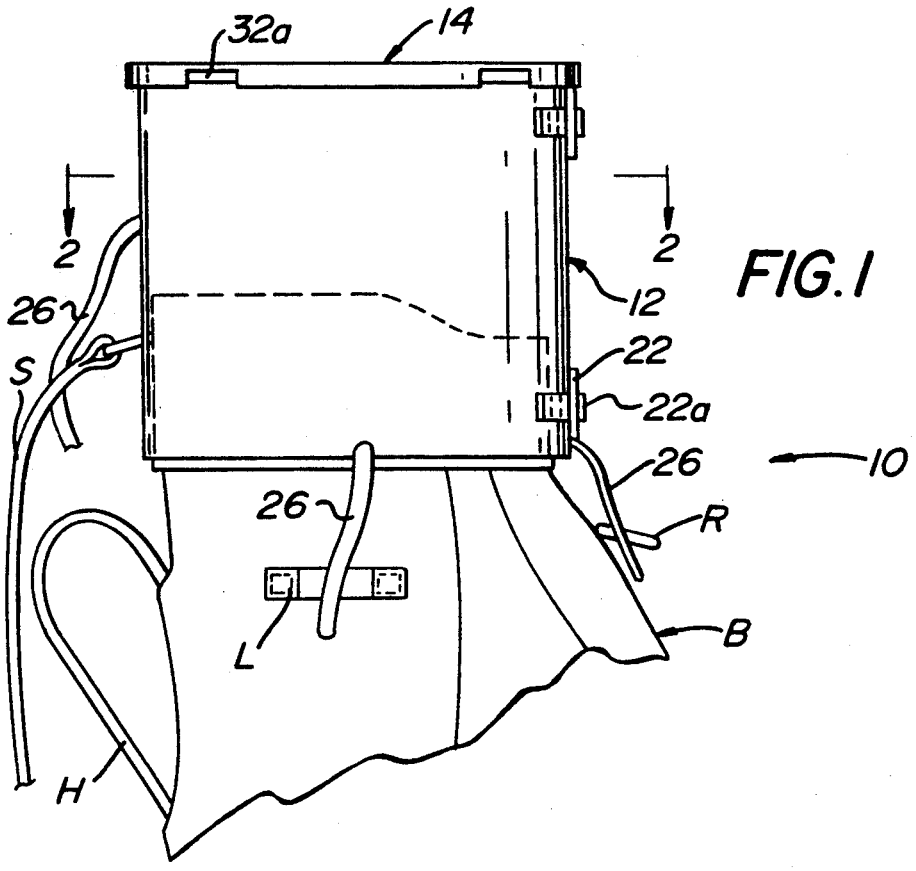
FIG. 1 is a side view of a two-piece protective hood for golf clubs, according to the invention, assembled and partially attached externally to the top of a golf bag.
Figure 2:
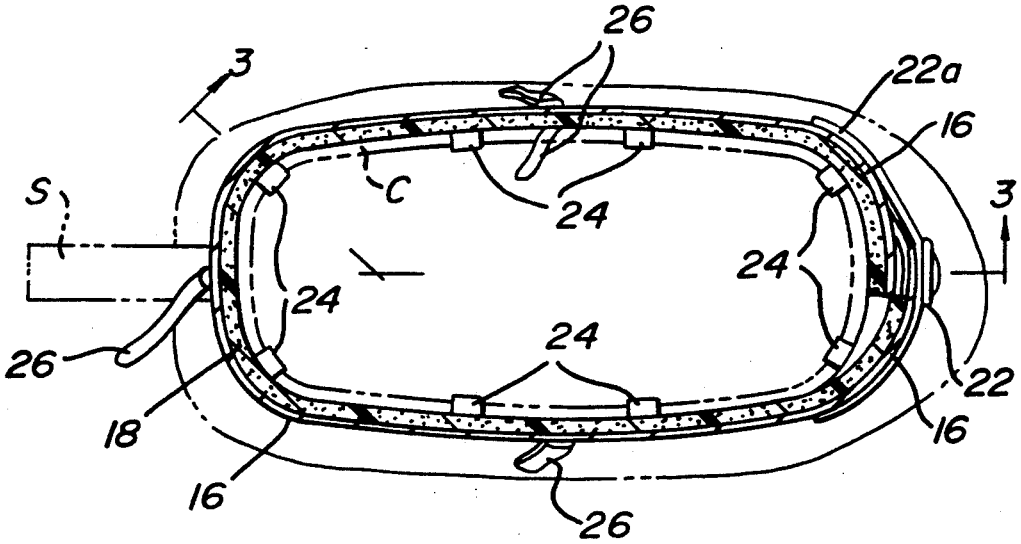
FIG. 2 is a sectional view of the assembled hood taken along the line 2—2 of FIG. 1.

Referring now to the drawings wherein like characters designate like or corresponding parts throughout the several views, there is shown in FIG. 1 a golf club protective hood assembly 10, mounted on the upper portion of a golf bag B, which ideally includes a relatively rigid metal-reinforced collar C around the opening at the upper end, a carrying handle H below the collar, and a shoulder strap S attached at one end to collar C and at the other end, not shown, to the lower portion of the bag. Other appendages are also provided on the bag for carrying various accessories such as a loop L for an umbrella, a ring R for club head covers or a ladies purse, and internal compartments lanyards T (FIG. 3).

Figures 5, 6, 7, 8:
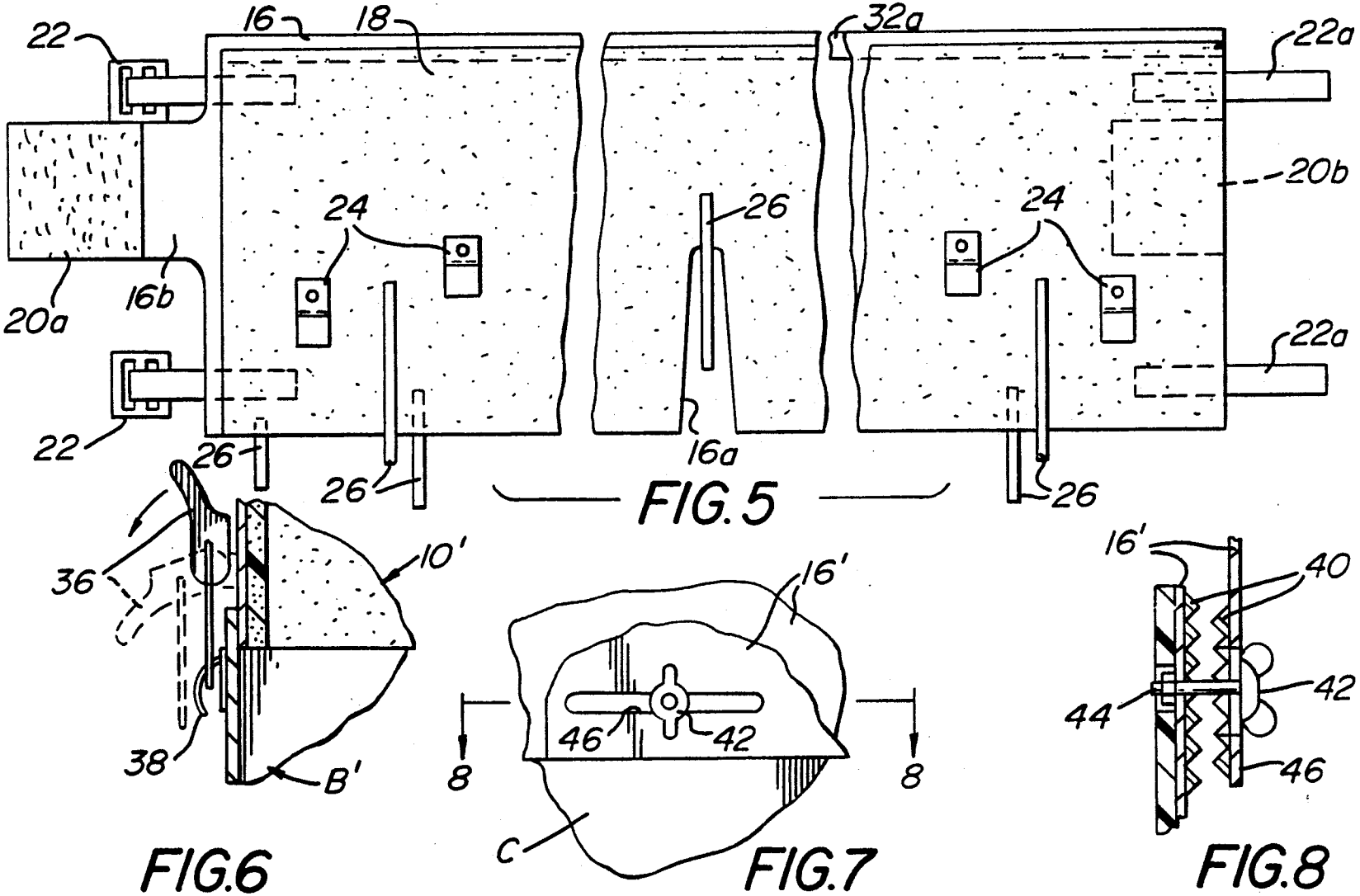
FIG. 5 is a view of a sleeve of the hood outstretched in an unstressed state.
FIG. 6 is a fragmentary side view of the assembled hood installed inside a golf bag opening by an over-center clamp fastener.
FIG. 7 is a fragmentary side view of the assembled hood with an alternate fastener for joining the ends of the sleeve.
FIG. 8 is a schematic representation of the fastener of FIG. 7 taken along the line 8—8.

Hood assembly 10 consists of two separate and discrete components: a sleeve 12 and a lid 14 attachable thereto. Referring to FIG. 5, sleeve 12 comprises a generally elongate rectangular shell 16 of hard and flexible material and of sufficient length which, when curved lengthwise around collar C, allows the ends to overlap. The width is sufficient to support lid 14 above all of the clubs, not shown, which would protrude above the rim of collar C. The shell material is preferably a durable impact-resistant metal or plastic sheet.

Approximately midway between the ends of shell 16, a notch **16*a* extends across at a width and a depth sufficient for fitting around the end of the strap S where it attaches to collar C when it is formed into sleeve 12 and properly installed. Cut-outs and shell configurations to fit the styles and fittings of other bags are possible without departing from the fundamental inventive concepts herein described. One side of shell 16 includes a liner 18** contiguously fixed thereto forming thereby the interior surface of sleeve 12. Liner 18 is preferably a soft elastomeric material for cushioning the impact of any loose clubs against the shell 16.

Shell 16 further defines a tab **16*b* extending from one end with one interlocking member 20*a* of a hook-and-loop type fastener such as Velcro® fixed to the inner side of tab 16*b*. The other interlocking member 20*b* is fixed to the outside of shell 16 at the other end. The fastening members are positioned relative to each other to interengage when shell 16 is curved around the bag collar C to form sleeve 12. Additional buckles 22 and straps 22*a* affixed to the outer surfaces of shell 16** at the opposite ends thereof provide supplemental fastening.

A series of clips 24 fixed in spaced relation to each other along the length of shell 16 and projecting inwardly and downwardly from liner 18 are positioned from the bottom edge of shell 16 according to the contour of the rim of collar C. When sleeve 12 is properly installed, the rim is fully seated in clips 24. Tie-downs 26, fixed to the inner and outer surfaces of shell 16, are provided at locations within tieing reach of strap S, loop L, ring R and lanyard T to secure sleeve 12 to bag B. Of course, it is understood that other locations for clips 24 and tie-downs 26 are contemplated depending on the contour of the collar rim and location of the golf bag appendages.

As best illustrated in FIGS. 3 and 4, lid 14 includes a flat panel 30, preferably of the same material as shell 16, with a perimeter generally of the same size and shape as the transverse cross sectional opening of collar C in order to enclose the top of sleeve 12 when the bottom end is secured around the collar opening. A continuous ridge **30*a* projecting from the inside margin of panel 30 and recessed from the perimeter thereof provides a snug fit with sleeve 12** when secured about collar C.

Panel 30 is retained on sleeve 12 by interlocking members **32*a* and 32*b* of a hook-and-loop type fastener. One member 32*a* is affixed to the outer surface of shell 16 along its entire upper margin. The other member 32*b* is segmented and fixed to the perimeter of thin, flexible flaps 34, such as a strong and durable fabric, secured at spaced intervals around the top margin of panel 30. FIG. 4 shows, in broken outline, the outer edges of flaps 34 outstretched from the periphery of panel 30. When lid 14 is in place on sleeve 12, the edges are turned down allowing the interlocking members 32*a* and 32*b* to engage and tightly secure lid 14 to sleeve 12**.

Installation of the hood assembly should now be readily apparent. With bag B preferably in the upright position, sleeve 16 is held at its ends in both hands with notch **16*a* registered over shoulder strap S at its connection with collar C. As the ends are curved toward each other around the collar C, shell 16 is moved downwardly until the rim of collar C is fully seated within clips 24. The shell ends are then overlapped and tightly secured by hook-and-loop members 20*a* and 20*b*, and buckles 22 secured to straps 22*a*. Lid 14 is then pressed onto the top of sleeve 12 and secured by hook-and-loop members 32*a* and 32*b* upon turning down flaps 34. Finally, tie-downs 26** are connected to their associated golf bag appendages.

FIG. 6 illustrates a means for securing the protective hood to the inside surface of the golf bag opening. Hood assembly 10' and bag B' are slightly modified versions of the aforedescribed to include an over-center clasp 36 fixed to shell 16 and an interengaging hook 38 fixed to the bag.

FIGS. 7 and 8 represent an alternate means for clamping the ends of shell 16'. Intermeshing teeth 40, fixed to facing end surfaces of shell 16' are secured by tightening a wing, nut 42 on a bolt 44 extending from one end of shell 16' through a transversely aligned slot 46 in the other end. Bolt 44 may slide within the slot thereby allowing tightening adjustment of shell 16' for slight variations in the size of the golf bag collar C.

Although the above-described protective hood assembly 10 is tailored for a illustrated golf bag B configuration, it should be noted that the sleeve and lid components 12 and 14 may be universally configured to fit a large variety of golf bag openings within a range of shapes and sizes without departure from the fundamental invention concepts herein described and claimed.

Some of the many advantages and novel features should now be readily apparent. For example, a two-piece golf bag hood is provided which can be readily assembled and attached to the top of a golf bag for protecting clubs from damage due to rough handling during transport. When the components are assembled, they become a unitary rigid structure, thus affording optimum protection of the clubs. It can be quickly disassembled for convenient storage, such as flat or curved along the walls of a trunk compartment of an automobile or rolled up in the golf bag. The hood can be easily tailored to fit most conventional or customized golf bags.

It will be understood of course, that various other changes in the materials, steps and arrangements of parts which have been herein described and illustrated in order to explain the nature of the invention, may be made by those skilled in the art within the scope of the invention as expressed in the appended claims.

I claim:

1. A hood assembly for installation on a golf bag, comprising, in combination:

sleeve means fabricated of a generally flat elongate shell of hard flexible sheet material of sufficient length to encircle with overlapping ends the circumference of the open end of the bag;

first fastening means for selectively interlocking the overlapping ends; and lid means formed of a generally flat hard material having a perimeter generally congruent with a transverse cross section of the open end of the bag; and second fastening means for selectively interlocking said lid means to the upper margin of said sleeve means when said first fastening means interlocks the overlapping ends of said sleeve means.

2. A hood assembly according to claim 1 further comprising:

a plurality of clips extending inwardly and downwardly from said sleeve means and positioned to engage a rim at the open end of the bag when said sleeve means is installed on the bag.

3. A hood assembly according to claim 1 further comprising:

a plurality of tie-downs fixed to said sleeve means and positioned to be tied to respective appendages on the bag when said sleeve means is installed on the bag.

4. A hood assembly according to claim 1 wherein:

said sleeve means includes a tab extending from one of said overlapping ends; and said first fastening means includes interlocking hook-and-loop members, one of said members being fixed to said tab, and the other member being fixed to the other end of said sleeve means for registering with said one member.

5. A hood assembly according to claim 1 wherein:

said second fastening means includes interlocking hook-and-loop members, one of said members being fixed to the upper margin of said sleeve means, flexible flap secured to said lid means at spaced intervals along the perimeter thereof, and the other of said members being fixed to the outer margins of said flaps for registering with said one member when turned down over the upper margin of said sleeve means.

6. A hood assembly according to claim 1 further comprising:

an elastomeric means fixed to the inner surface of said sleeve means for absorbing impact of any loose contents in the bag.

7. A hood assembly according to claim 1 further comprising:

third fastening means including at least one buckle and strap for securing the overlapping ends of said sleeve means when contiguously encircling the open end of the bag.

8. A hood assembly according to claim 1 further comprising:

a clasp fixed to said sleeve means and positioned to interlock with a mating hook appended to the bag.

9. A hook assembly according to claim 1 wherein:

said shell includes a transverse slot in one of said overlapping ends;

said first fastening means includes intermeshing teeth fixed to facing surfaces of said overlapping ends, a bolt extending from one of said ends adjacent said teeth and extending through said slot formed in the other end of said overlapping when said sleeve means encircles, and a nut threadable on said bolt for tightening said teeth in meshing engagement.

* * * * *